US007251862B2

(12) United States Patent
Pischel

(10) Patent No.: US 7,251,862 B2
(45) Date of Patent: Aug. 7, 2007

(54) GUIDE ELEMENT ASSEMBLY FOR A SPINNING PREPARATION MACHINE

(75) Inventor: Robert Pischel, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 425 days.

(21) Appl. No.: 10/912,088

(22) Filed: Aug. 6, 2004

(65) Prior Publication Data

US 2005/0044670 A1 Mar. 3, 2005

(30) Foreign Application Priority Data

Aug. 28, 2003 (DE) ..... 103 40 060

(51) Int. Cl.
*D01G 15/40* (2006.01)

(52) U.S. Cl. ..... 19/105

(58) Field of Classification Search ..... 19/65 A, 19/105

See application file for complete search history.

(56) References Cited

U.S. PATENT DOCUMENTS 5,084,941 A * 2/1992 Brockmanns et al. ..... 19/151
5,944,405 A 8/1999 Takeuchi et al.
5,983,456 A * 11/1999 Leifeld ..... 19/150
6,477,734 B1 * 11/2002 Gresser et al. ..... 15/309.1

FOREIGN PATENT DOCUMENTS

DE 39 02 204 A1 8/1990
DE G 90 17 757.6 U1 2/1992
DE 298 10 694 U1 11/1998

* cited by examiner

*Primary Examiner*—Shaun R. Hurley
(74) *Attorney, Agent, or Firm*—Venable LLP; Robert Kinberg; Steven J. Schwarz

(57) ABSTRACT

In an apparatus at a spinning preparation machine, especially a carding machine, opener, cleaner or the like, a guide element, guide vane or the like having a curved end region is movably mounted in a recess in a stationary mounting. In order to allow simple production, assembly and handling, the recess has, at least in part, straight inner wall surfaces, and the guide element is fixed by means of a clamping force relative to the mounting and, without the clamping force, can be moved.

21 Claims, 3 Drawing Sheets

GUIDE ELEMENT ASSEMBLY FOR A SPINNING PREPARATION MACHINE

CROSS REFERENCE TO RELATED APPLICATION

This application claims the priority of German Patent Application No. 103 40 060.5 dated 28 Aug. 2003, the disclosure of which is incorporated herein by reference.

BACKGROUND OF THE INVENTION

The invention relates to an apparatus at a spinning preparation machine, especially a carding machine, opener, cleaner and the like, wherein a guide element, guide vane or the like having a curved end region is movably mounted in a recess in a stationary mounting.

In a known apparatus, the curved end region is mounted in the recess of a mounting having curved inner walls, the end region being retained by means of an additional cover over the recess, preventing it from falling out. The curved inner walls are laborious to produce from a manufacturing point of view.

It is an aim of the invention to provide an apparatus of the kind described at the beginning which avoids or mitigates the mentioned disadvantage and which especially allows simple production, assembly and handling.

SUMMARY OF THE INVENTION

The invention provides a guide element assembly for a spinning preparation machine, comprising a guide element having a curved mounting region and a mounting having a recess with at least one substantially flat inner wall, wherein the curvature of the mounting region and the configuration of the or each substantially flat inner wall surface are so selected that the mounting region of the guide element is rotatable within the mounting.

The invention also provides a guide element assembly for a spinning preparation machine comprising:

a guide element having an at least partly curved mounting region;

a stationary mounting having a recess with at least one substantially flat inner wall;

a clamping device for clamping the guide element in a fixed position relative to the mounting;

wherein, when the mounting region is located in the recess the mounting region is movable when the clamping device is arranged to apply no clamping force and is retained in a fixed position relative to the mounting when a clamping force is applied.

The apparatus according to the invention allows simple manufacture, especially of the straight inner wall surface of the recess. It is economical to produce. It is, moreover, simple to handle (assemble)—position correctly and tighten the clamping device, for example, screw. The setting of the guide element thereby obtained does not move again once the clamping device has been tightened. The guide element is advantageous in terms of flow (no undesirable piecings). The apparatus according to the invention is also especially suitable for settings that are established during assembly and do not constantly need to be changed in use. The air flow conditions are adjustable. The setting can be modified in line with various roller diameters.

In certain embodiments the recess may have, in cross-section, a prismatic shape. Advantageously, the end region and the inner wall surfaces together have a clamping point or clamping line. Advantageously, a non-positive connection is brought about between the guide element and the mounting. Advantageously, a fastening element, for example, a fixing screw, is associated with the guide element at its end (mounting) region. Where the fastening element is a screw, at the end region there is advantageously provided a hole having an internal thread, which co-operates with the fixing screw. Advantageously, the fixing screw passes through a through-hole in the mounting housing. Advantageously, the fixing screw bears against the mounting housing. Advantageously, between the fixing screw and the wall surfaces of the hole there is provided a spacing, which allows the fixing screw to be variously positioned in a lateral direction. Advantageously, between the head of the fixing screw and the mounting housing there is provided a washer, for example, split washer or the like. Advantageously, the washer, for example, a split washer or the like, is curved. Advantageously, the clamping force is produced or introduced by the fixing screw. Advantageously, the clamping force brings about fixing of the end region in a radial direction. Advantageously, without the clamping force, pivoting of the guide element, guide vane or the like is possible.

Advantageously, the guide element, guide vane or the like is arranged at the open intake slot of a suction hood. Advantageously, the suction hood is arranged at a carding machine. Advantageously, the suction hood is associated with a high-speed cleaner roller. Advantageously, the suction hood is associated with a high-speed clothed roller of a carding machine or cleaner. Advantageously, the free ends of the guide element, guide vane or the like project into the nip between two co-operating high-speed rollers of an opener, cleaner or the like. Advantageously, the free end of the guide element, guide vane or the like projects into the nip between two co-operating high-speed lickers-in of a carding machine. Advantageously, adjustment of the guide element, guide vane or the like is capable of modifying the air currents, the air flow conditions or the like.

DESCRIPTION OF PREFERRED EMBODIMENTS

Figure 1:
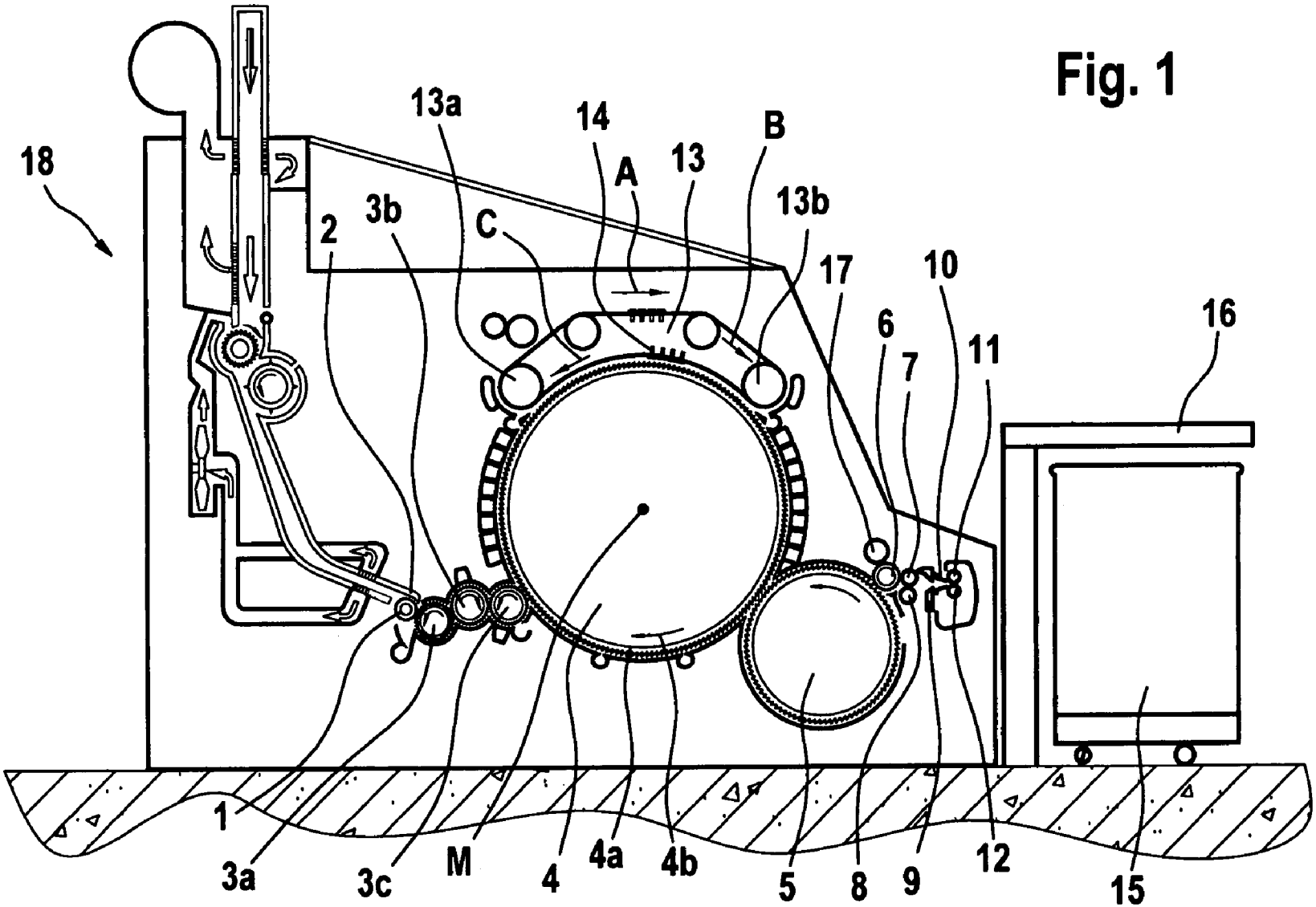
FIG. 1 is a diagrammatic side view of a carding machine having a guide element and mounting according to the invention.

With reference to FIG. 1, a carding machine, for example a TC 03 (Trade Mark) carding machine made by Trutzschler GmbH & Co. KG of Monchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers 11, 12, revolving card top 13 having card-top-deflecting rollers 13*a*, 13*b* and card top bars 14, can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. Reference letter C denotes the direction of rotation of the revolving card top 13 at the carding location and reference letters A and B denote the direction in which the card top bars 14 are moved on the reverse side. Reference numeral 17 denotes a high-speed cleaner roller for the stripper roller.

Figure 2:
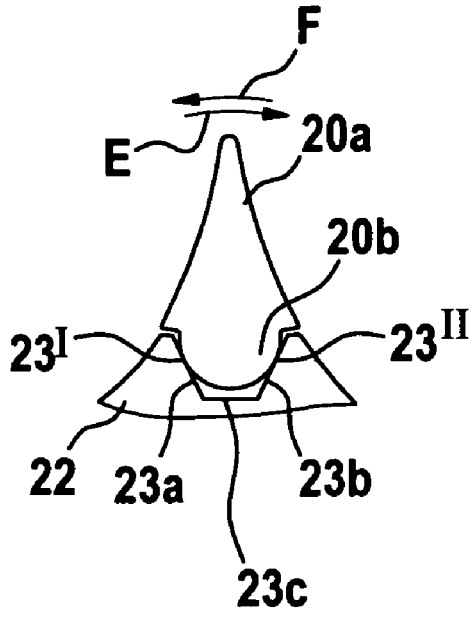
FIG. 2 is a side view of suction hood having a guide element and mounting according to the invention, at a cleaner roller.
Figure 2A:
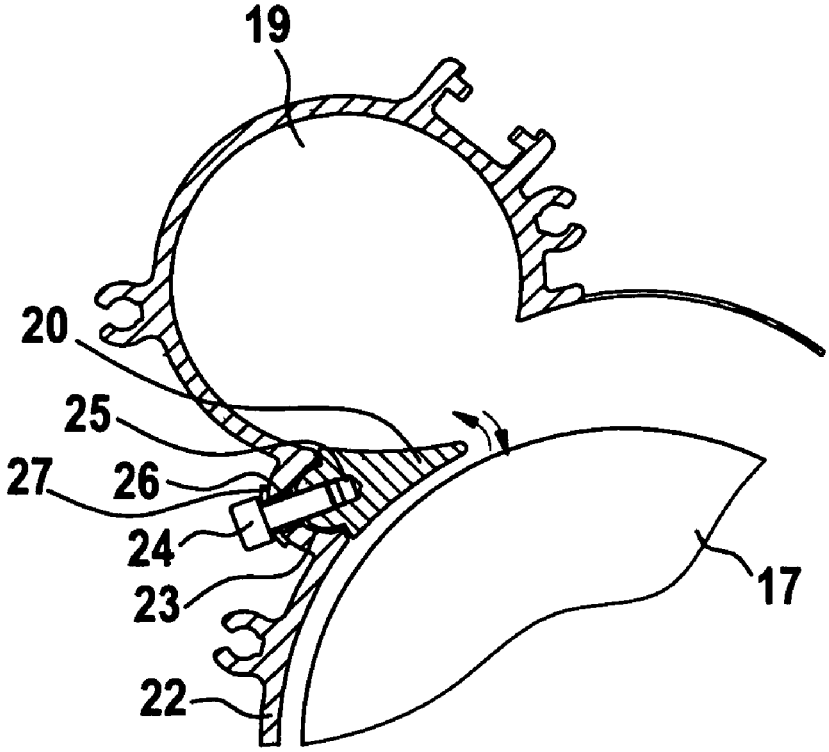
FIG. 2*a* is a side view of an adjustable guide vane together with its mounting.

In the embodiment of FIGS. 2 and 2*a*, a suction hood 19 is associated with the high-speed cleaner roller 17 for the stripper roller 6; the guide element 20 is arranged at the slot-shaped entrance to the suction hood 19. In the curved end region 20*b* (see FIG. 2*a*) there is provided a hole 25 having an internal thread, which is in engagement with the external thread of a fixing screw 24. The fixing screw 24 passes through a through-hole 26 in the mounting housing 22 and bears against the mounting housing by way of a curved washer 27. As FIG. 2 shows, the curved end region 20*b* and the straight wall surface 23*a* and 23*b* come into contact with one another at the points 23' and 23", respectively. Reference numeral 23*c* denotes the bottom surface of the recess 23. The guide element 20 is fixed and held in a position when the fixing screw 24 is tightened (a high degree of surface pressure at 23' and 23"). Reference numeral 20*a* denotes the free end region of the guide element 20. Between the fixing screw 24 and the inner walls of the hole 26 there is a spacing or a sufficiently large amount of play to allow the screw 24 to be moved to the side into various positions and, as a result, to allow the free end 20*a* of the guide element 20 to be variously positioned—accompanied by displacement of the points 23' and 23" along the inner wall surfaces 23*a* and 23*b*, respectively. The guide element 20 can be moved or pivoted in the direction of arrows E, F. The recess 23 has a trapezoidal cross-section and is open on one side.

Figure 3:
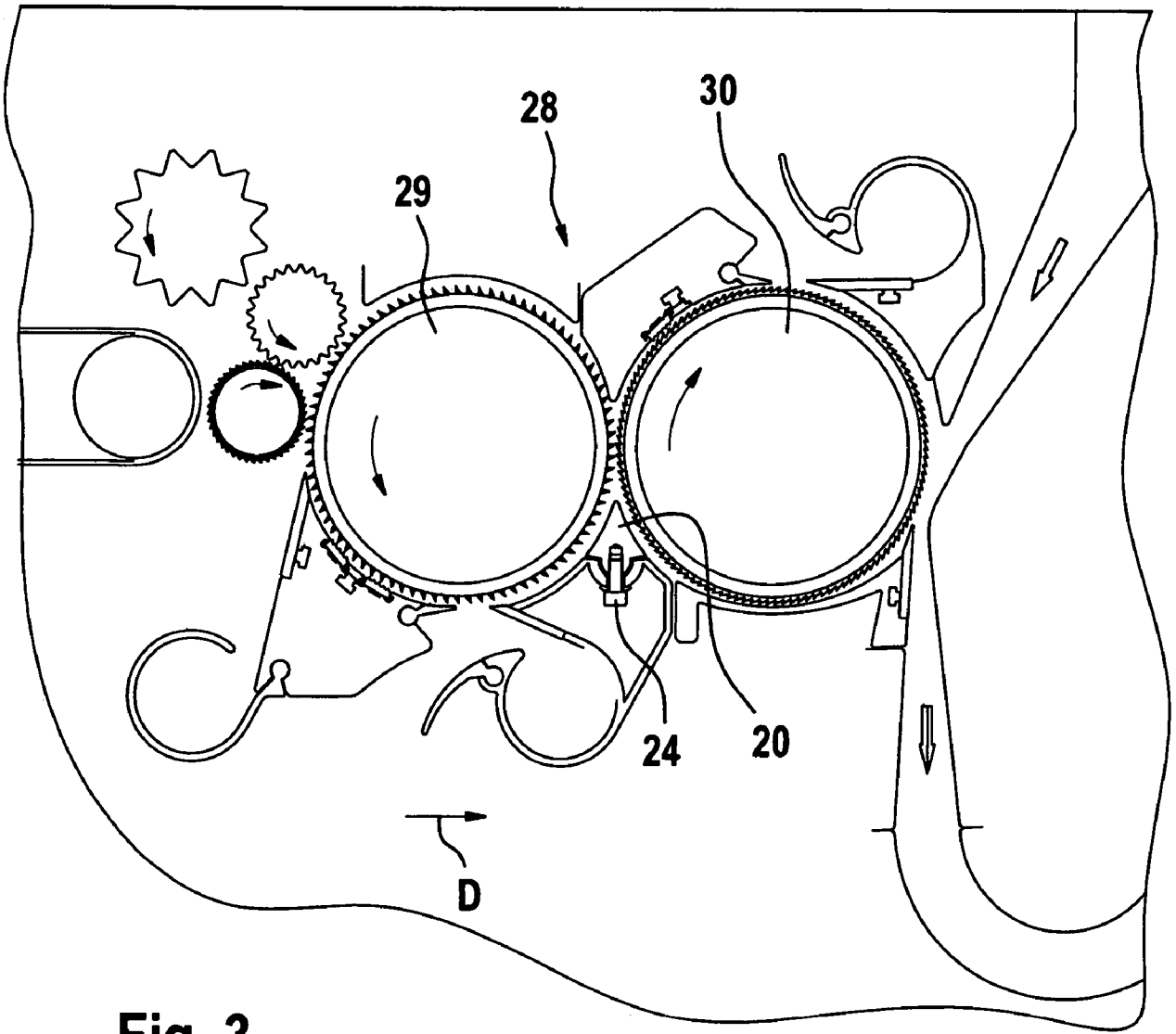
FIG. 3 is a side view of a cleaner having a guide vane according to the invention at the nip between two rollers.

In the embodiment of FIG. 3, two high-speed clothed rollers 29, 30, one arranged downstream of the other, co-operate with one another in a cleaning machine 28, for example a CLEANOMAT CL (Trade Mark) made by Trützschler GmbH & Co. KG, which is for textile fibres, for example cotton. Projecting into the lower nip between the rollers 29 and 30 is the free end region 20*a* of the guide element 20, which is constructed in accordance with FIGS. 2 and 2*a*.

An arrangement like that of FIG. 3 may also be provided in a nip between the lickers-in 3*a*, 3*b*, 3*c* of the carding machine of FIG. 1.

Although the foregoing invention has been described in detail by way of illustration and example for purposes of understanding, it will be obvious that changes and modifications may be practised within the scope of the appended claims.

What is claimed is:

1. A guide element assembly for a spinning preparation machine, comprising a guide element having a convexly curved mounting region and a mounting having a recess adapted to receive the convexly curved mounting region, the recess having at least one substantially flat inner wall, wherein the convexly curved mounting region and the at least one substantially flat inner wall contact one another and allow the convexly curved mounting region to rotate within the recess.

2. A guide element assembly for a spinning preparation machine comprising:

a guide element having an at least partly curved mounting region;

a stationary mounting having a recess with at least one substantially flat inner wall;

a clamping device for clamping the guide element in a fixed position relative to the mounting;

wherein, when the mounting region is located in the recess the mounting region is movable when the clamping device is arranged to apply no clamping force and is retained in a fixed position relative to the mounting when a clamping force is applied.

3. A guide element assembly according to claim 2, in which the recess has, in cross-section, first and second substantially flat walls, the second substantially flat wall being spaced from, and inclined relative to, the first substantially flat wall.

4. A guide element assembly according to claim 2, in which the mounting region and the inner wall surfaces together define a clamping point or clamping line.

5. A guide element assembly according to claim 2, in which the clamping involves a non-positive connection between the guide element and the mounting.

6. A guide element assembly according to claim 2, in which the clamping device comprises a fastening element associated with the mounting region of the guide element.

7. A guide element assembly according to claim 6, in which the fastening element has a screw thread and the mounting region has a hole having an internal thread, for co-operating with the threaded fastening element.

8. A guide element assembly according to claim 6, in which the mounting comprises an aperture through which the fastening element extends.

9. A guide element assembly according to claim 8, in which the fastening element bears against the mounting housing.

10. A guide element assembly according to claim 8, in which the diameter of the aperture is greater than the diameter of that part of the threaded fastening element that is located within the aperture, whereby the orientation of the fastening element within the aperture can be varied.

11. A guide element assembly according to claim 8, in which the fastening element comprises a head which is located outside the recess in use and the clamping device further comprises a washer that can be located between said head and an outer surface region of said mounting adjacent to the aperture.

12. A guide element assembly according to claim 11, in which the washer is curved.

13. A guide element assembly according to claim 2, in which, without the clamping force, pivoting of the guide element is possible.

14. A guide element assembly according to clam 2, in which the stationary mounting is a portion of a housing of a spinning preparation machine and the guide element is arranged at the open intake slot of a suction hood of said machine.

15. A guide element assembly according to claim 14, in which the suction hood is arranged at a carding machine.

16. A guide element assembly according to claim 15, in which the suction hood is associated with a high-speed clothed roller of a carding machine or cleaner.

17. A guide element assembly according to claim 14, in which the suction hood is associated with a high-speed cleaner roller.

18. A guide element assembly according to claim 2, in which the stationary mounting is a portion of a housing of an opener or cleaner and projects into the nip between two co-operating high-speed rollers of the opener or cleaner.

19. A guide element assembly according to claim 2, in which the stationary mounting is a portion of a housing of a carding machine and the guide element projects into the nip between two co-operating high-speed lickers-in of the carding machine.

20. A guide element assembly for a spinning preparation machine, comprising a guide element having a mounting portion and a guide portion, a stationary mounting which comprises a recess for receiving the mounting portion of the guide element, and a clamping device, wherein the mounting portion has a surface which is at least partly curved, the recess has at least one substantially flat inner wall surface, and the clamping device is arranged to apply a clamping force for fixing the mounting portion in a fixed position with at least one portion of said partly curved surface of said mounting portion in contact with a portion of said substantially flat inner wall surface, wherein the absence of said clamping force the mounting portion is permitted by said substantially flat inner wall surface to move relative to the mounting.

21. An apparatus at a spinning preparation machine, wherein a guide element, guide vane or the like having a curved end region is movably mounted in a recess in a stationary mounting, and the recess has, at least in part, straight inner wall surfaces, and the guide element is fixed by means of a clamping force relative to the mounting and, without the clamping force, can be moved.

* * * * *